US005401575A

United States Patent [19]

Anglin et al.

[11] Patent Number: 5,401,575

[45] Date of Patent: Mar. 28, 1995

[54] ALUMINUM SHEET COATED WITH A LUBRICANT COMPRISING DIOCTYL SEBACATE AND PETROLATUM

[75] Inventors: James R. Anglin, Murrysville, Pa.; Theresa S. Knighton; H. Gray Reavis, Jr., both of Newburgh, Ind.

[73] Assignee: Aluminum Company of America, Pittsburgh, Pa.

[21] Appl. No.: 985,305

[22] Filed: Dec. 4, 1992

[51] Int. Cl.[6] ..... B32B 15/08; B32B 15/04

[52] U.S. Cl. ..... 428/341; 252/56 S; 428/457; 428/463; 428/467

[58] Field of Search ..... 252/56 R, 56 S; 428/219, 457, 463, 467, 341; 413/18

[56] References Cited

U.S. PATENT DOCUMENTS

| | | | |
|---|---|---|---|
| Re. 31,349 | 8/1983 | Smith et al. | 413/18 X |
| Re. 32,653 | 4/1988 | Forsberg | 252/33 |
| 3,765,955 | 10/1973 | Kushima et al. | 428/469 |
| 3,899,433 | 8/1975 | Unick et al. | 252/52 R |
| 4,144,178 | 3/1979 | Katabe et al. | 252/8.9 |
| 4,321,308 | 3/1982 | Jahnke | 428/457 |
| 4,495,156 | 1/1985 | Rohowetz | 427/384 |
| 4,839,202 | 6/1989 | Grassel et al. | 427/424 |
| 4,988,536 | 1/1991 | Van Dongen et al. | 427/39 |
| 5,062,928 | 11/1991 | Smith | 204/15 |
| 5,102,567 | 4/1992 | Wolf | 252/56 R X |
| 5,156,720 | 10/1992 | Rosenfeld et al. | 205/76 |

FOREIGN PATENT DOCUMENTS

| | | | |
|---|---|---|---|
| 02043382 | 2/1990 | Japan | C23F 11/00 |
| 04013877 | 1/1992 | Japan | C23C 22/33 |
| 9106619 | 5/1991 | WIPO . | |

*Primary Examiner*—Paul J. Thibodeau
*Assistant Examiner*—Stephen Sand
*Attorney, Agent, or Firm*—Gary P. Topolosky; Glenn E. Klepac

[57] ABSTRACT

Metal sheet product, more particularly food or beverage can tab and end stock, is treated with a lubricant blend consisting essentially of about 25–90 wt % bis(2-ethylhexyl)sebacate or DOS; about 10–75 wt % petrolatum and a balance of incidental additives and impurities prior to coiling for transport and storage. With said composition applied hereon, in preferred average thicknesses between about 10–110 mg/ft$^2$ for aluminum can tab stock and up to about 35 mg/ft$^2$ for aluminum can end stock, the invention produces prelubricated can stock in a suitable condition for conversion into can tabs and/or can ends without further lubrication.

26 Claims, No Drawings

ALUMINUM SHEET COATED WITH A LUBRICANT COMPRISING DIOCTYL SEBACATE AND PETROLATUM

BACKGROUND OF THE INVENTION

1. Field of the Invention

This invention relates to the field of lubricating metal sheet product suitable for use as food and beverage can stock. The invention specifically relates to manufacturing pre-lubricated tab and end stock from 5000 Series aluminum alloys (Aluminum Association designations) such as 5042, 5082 and 5182 aluminum. An improved tab and end can stock lubricating composition and method are also described herein.

2. Technology Review

The aluminum industry supplies can manufacturers with millions of pounds of coiled sheet product each year. These manufacturers convert such sheet product into can bodies, ends and tabs for beer, beverages and certain foodstuffs. A substantial portion of aluminum sheet product is coated with a lubricant composition on one or both outer surfaces, typically by the can maker, prior to fabrication of the can bodies, ends and/or tabs. Lubricant coatings for any packages of food or beverages must meet all applicable U.S. Food and Drug Administration (FDA) requirements.

Lubricants, including liquids and solids, are used in metal working operations to reduce friction and wear between the surface of metal being worked and surfaces of the apparatus carrying out a given metal working operation. Lubricants reduce friction and wear by separating the contacting surfaces in relative motion with a thin fluid film of an appropriate composition.

In addition to their friction and wear reducing characteristics, lubricant compositions are expected to fulfill certain other requirements for industrial usage. They should be easy to apply and remove, where removal is warranted; afford some protection to the metal surface during handling and storage; present no health hazards to persons coming in contact with the composition; and be inert to the surfaces in contact therewith. Some lubricants produce severe stains on the metal surfaces they contact. It is highly desirable to avoid the staining of metal surfaces by using a lubricant of appropriate composition or blend having the properties demanded by the particular conditions under which the metal product will be worked.

It is known to apply lubricant compositions to aluminum sheet products through numerous methods. One representative means employs a spray coater or atomizer as set forth in Grassel U.S. Pat. No. 4,839,202, the disclosure of which is fully incorporated by reference. With the latter device, a lubricant composition consisting of only dioctyl sebacate (DOS), or bis(2-ethylhexyl)sebacate, is electrostatically deposited at a rate of about 1 mg/ft$^2$ on both outer surfaces of beverage can stock. The purchaser of such metal, the can manufacturer, typically uncoils such stock to apply a second lubricant thereon before feeding his metals into the can tab or end conversion press.

Still other known lubricant application means include passing sheet product through any of various applicators which generate fine droplets of lubricant for deposit on said sheet product with electrostatic assistance, or between one or more rotating roll pairs having at least some portion of a roll surface in contact with, cowered by material of or immersed in a lubricant reservoir. The lubricant composition/blend of this invention can be applied by any of the foregoing means. On a less preferred basis, the invention may be added to one or more solvents prior to sheet metal application, said solvent(s) being suitable for flashing off and recovery for reuse.

SUMMARY OF THE INVENTION

It is a principal objective of this invention to provide a lubricant composition and method for can tab and end stock that imparts improved friction and wear performance over either principal component alone. It is another objective to provide food or beer and beverage can stock with a prelubricated surface so as to eliminate, or significantly reduce, the number of occasions where and amount of second lubricant subsequently applied to can stock by the purchaser immediately prior to tab or end manufacture. It is yet another objective to provide a sheet product, composition and method which avoid the difficulties associated with tenacious lubricant-containing buildup on tooling and with excessive or uneven buildup on the rolls downstream from the lubricant application equipment.

Still other factors critical to the commercial success of can tab and end stock, made from aluminum or any other metal according to this invention, include: having a chemical composition and the proper prelube consistency for imparting adequate formability to the metal product as it is being worked; appropriate compatibility with the container's contents (food, beer or beverage); not having an undesirable taste and minimal impact on beer's foam properties; being compatible with current application techniques and hardware; and having optimum formability at a minimum applied weight/thickness or rate. On a preferred basis, said lubricant system should enable on-line monitoring of the lubricant coverage being applied to can stock using existing technology.

In accordance with the foregoing objectives and advantages, there is provided metal sheet product, more particularly food or beverage can tab and end stock, which has been treated with a lubricant blend consisting essentially of about 25–90 wt % bis(2-ethylhexyl)sebacate; about 10–75 wt % petrolatum and a balance of incidental additives and impurities. With the application of said composition/blend, in preferred average coverage rates of up to about 300 mg/ft$^2$, and more preferably between about 10–110 mg/ft$^2$ for aluminum can tab stock and from about 35 mg/ft$^2$ for aluminum can end stock, the invention produces prelubricated can stock in a suitable condition for forming into can tabs and/or can ends without further lubrication. A method for supplying prelubricated can tab and end stock is also disclosed.

DETAILED DESCRIPTION OF PREFERRED EMBODIMENTS

In the following detailed description, repeated reference is made to the application of preferred lubricant composition/blends to 5000 Series aluminum sheet product (Aluminum Association designation) or products consistent with such designations if not currently registered with the Aluminum Association. It is to be understood, however, that this same composition and method may have other applications to steel and other food or beverage can stock.

When referring to any numerical value, or range of values throughout this detailed description and the accompanying claims, it is to be understood that each range expressly includes every full and fractional number between the stated range maximum and minimum, such that a compositional blend including about 60–85 wt % DOS would cover any prelube-blend having 61, 62, 63% DOS, as well as 63.5, 63.7 and 63.9%, up to and including 84.999% DOS.

A first principal component of the lubricant blend of this invention comprises bis(2-ethylhexyl)sebacate, also known more generically as dioctyl sebacate or DOS. This compound exists as a diester of dicarboxylic acid having the general formula: $C_8H_{17}OOC(CH_2)_8COOC_8H_{17}$, or more precisely as: $C_4H_9CH(C_2H_5)CH_2OOC(CH_2)_8COOCH_2CH(C_2H_5)C_4H_9$. It exists in liquid form and has been used alone as a thin layer lubricant for aluminum can tab stock, but never as a thick layer prelubricating compositional blend that obviates the need to add further (i.e., second) lubricant layers to uncoiled sheet prior to conversion into can end or tab parts.

The second principal component hereof is a mineral oil derivative, petrolatum, which is more commonly known as petroleum jelly. Said material has a significantly higher viscosity than DOS, which necessitates the full or partial melting of petrolatum prior to its typical sheet product application as a lone lubricant. Because of this semi-liquid, semi-solid state, it is also very difficult to apply petrolatum to any sheet product in thin, film layers. Several grades of petrolatum are sold commercially depending on the impurity levels therein. Suitable grades include white and yellow petrolatum conforming to standards defined in 21 CFR §178.3700 and ranging in color from white to amber. All grades may be used in conjunction with DOS, with the use of higher grade, lower impurity level petrolatums, such as white petrolatum, depending on the cost upgrades associated therewith. For the practice of this invention, it has been determined that amber petroleum's higher impurity level has no detrimental effect on lubricant performance.

By "incidental additives and impurities", it is meant that the DOS being combined with commercially available petrolatum grades may include unknown quantities of other constituents. For example, the petrolatum obtained for purposes of this comparative study had trace amounts of an anti-oxidant. Minor levels of still other additives, both desired and undesired, may be present in any given sampling of constituent parts.

It has been determined through the practice of this invention that the application of a combination of these two lubricants, in preferred ratios of at least about 40 or 50 wt % DOS or greater, results in a synergistic effect on overall lubricant performance. That is why preferred embodiments of this method for making prelubed can stock insist on a full blending of the two component parts before application to the cleaned, sheet product substrate. On a less preferred basis, this composition may be applied near simultaneously in separate lubricant layers, with the first DOS layer positioned adjacent the metal surface and below an outermost layer of petrolatum when applied in multiple layers, the coiled can stock of this invention should have the opportunity to blend together between the layers during subsequent transfer and storage.

Table I that follows details the effect of various lubricant compositions on the Coefficient of Friction (COF) and Scar Rating of 5182 aluminum sheet according to various MOFISS-type tests, MOFISS being an acronym for "Moving Film Stationary Sled" type tests for lubricant/coating coverages. In such tests, a sled resting on a sheet sample makes contact on only the surfaces of fixed ball bearings which slide across the sheet during performance of the test. For this comparison, petrolatum and DOS were applied individually to respective specimens and in various petrolatum-to-DOS ratios (by weight percent). As can be seen below, the composition/blend consisting of 25 wt % petrolatum and a balance of bis(2-ethylhexyl)sebacate, or DOS, outperformed its other blend counterparts and 100% petrolatum alone.

TABLE I

| Lubricant Composition wt % Petrolatum:DOS | Avg. Thickness Coverage ($mg/ft^2$) | COF | Ball Scar Rating* |
|---|---|---|---|
| 100:0 | 20 | 0.188 | 3.7 |
| 75:25 | 19 | 0.149 | 1.5 |
| 50:50 | 19 | 0.153 | 0.7 |
| 25:75 | 18 | 0.155 | 0.5 |

*Ranges from 0 (no scar) to 4 (severe scarring).

In Table II, additional data were taken on respective samples of can stock prelubricated with DOS-alone and in combination with various blends of petrolatum, differing in color, name, and, of course, price, by the amount of impurities therein. "Amber Petrolatum", as sold by the Penreco Division of Pennzoil in Karns City, Pa., was the most impure of three petroleum jelly samplings compared. Such impurities did not have any detrimental effect on the MOFISS performance of blends to which this particular yellow grade of petrolatum was added, however. Penreco's "Snow White" and "Ultima" petrolatums, by contrast, did not perform any better as to warrant the additional costs associated with their acquisition.

Table II that follows contains additional data on the performance of respective samples after having been heat treated to simulate the effect of long-term storing and transport (or accelerated aging) of these can stocks. For each lubricant, the Ball Scar Rating (0–5 scale) and Sheet Wear Track Rating (0–5 scale) evaluations indicated the severity of wear observed on the contact surfaces of the sliding ball bearings and sheet, respectively, with higher numbers denoting more severe wear.

TABLE II

| Lubricant | Avg. Thickness Coverage[1] ($mg/ft^2$) | Room Temperature | | | After Accelerated Aging | | |
|---|---|---|---|---|---|---|---|
| | | COF | Ball Scar | Wear Track[2] | COF | Ball Scar | Wear Track |
| Pet./DOS (25:75) | Low | 0.16 | 1.0 | 2.0 | 0.13 | 1.0 | 2.0 |
| Penreco Amber | Low | 0.15 | 1.0 | 3.0 | 0.14 | 1.0 | 3.5 |
| | High | 0.16 | 1.0 | 2.0 | 0.13 | 1.0 | 2.0 |
| | High | 0.15 | 1.0 | 2.5 | 0.13 | 1.0 | 3.0 |
| Pet./DOS (25:75) | Low | 0.16 | 1.0 | 2.0 | 0.13 | 1.0 | 2.0 |
| Penreco Snow | High | 0.17 | 1.0 | 2.0 | 0.13 | 1.0 | 2.0 |

TABLE II-continued

| Lubricant | Avg. Thickness Coverage[1] (mg/ft²) | Room Temperature COF | Ball Scar | Wear Track[2] | After Accelerated Aging COF | Ball Scar | Wear Track |
|---|---|---|---|---|---|---|---|
| Pet./DOS (25:75) | Low | 0.16 | 1.0 | 2.0 | 0.15 | 1.0 | 2.0 |
| Penreco Ultima | High | 0.17 | 1.0 | 2.5 | 0.13 | 1.0 | 2.0 |
| DOS Only | Low | 0.18 | 1.0 | 2.0 | 0.83 | 4.7 | 5.0 |
| | Low | 0.13 | 1.0 | 3.0 | 0.52 | 3.7 | 5.0 |
| | High | 0.18 | 1.0 | 2.0 | 0.19 | 1.3 | 2.0 |
| | High | 0.13 | 1.0 | 2.5 | 0.19 | 1.5 | 5.0 |

[1]Coverage: low = 9–13 mg/ft²; high = 25–31 mg/ft²
[2]Ranges from 0 (Very Good) to 5 (Poor)

Having described the presently preferred embodiments, it is to be understood that the invention may be otherwise embodied by the scope of the claims appended hereto.

What is claimed is:

1. A metal sheet product suitable for making into food or beverage can tab stock, said tab stock having a first and second outer surface, at least one of said surfaces being lubricated with about 10–300 mg/ft², of a blended composition comprising:

(a) about 40–90% by weight of bis(2-ethylhexyl) sebacate; and (b) about 10–60 wt % petrolatum.

2. The sheet product of claim 1 wherein the metal is aluminum.

3. The sheet product of claim 2 wherein the aluminum is a magnesium-containing aluminum alloy.

4. The sheet product of claim 1 wherein the composition is applied to both outer surfaces by a process selected from the group consisting of, electrostatic, solvent addition, and roll coating.

5. The sheet product of claim 1 wherein said composition has been applied on at least one of its outer surfaces at an average coverage rate of about 10–110 mg/ft².

6. The sheet product of claim 5 wherein said composition has been applied on at least one of its outer surfaces at an average coverage rate of about 40–70 mg/ft².

7. The sheet product of claim 1 wherein said composition has been applied on at least one of its outer surfaces at an average coverage rate of about 10–35 mg/ft².

8. The sheet product of claim 7 wherein said composition has been applied on at least one of its outer surfaces at an average coverage rate of about 10–18 mg/ft2.

9. The sheet product of claim 1 wherein the composition consists essentially of about 60–85 wt % bis(2-ethylhexyl)sebacate and about 15–40 wt % petrolatum.

10. The sheet product of claim 9 wherein the composition consists essentially of about 75 wt % bis(2-ethylhexyl)sebacate and about 25 wt % yellow grade or higher petrolatum.

11. Beverage can tab stock made of metal sheet product and having a first and second outer surface, at least one of said surfaces being treated with about 10–300 mg/ft² of a lubricant blend consisting essentially of:

(a) about 40–90 wt % bis(2-ethylhexyl) sebacate; and (b) about 10–60 wt % petrolatum.

12. The tab stock of claim 11 wherein said lubricant blend consists essentially of about 65–80 wt % bis(2-ethylhexyl)sebacate and about 20–35 wt % petrolatum.

13. The tab stock of claim 11 wherein the metal sheet is made from a magnesium-containing aluminum alloy.

14. The tab stock of claim 11 wherein said lubricant blend is applied at an average coverage rate of about 10–110 mg/ft².

15. The tab stock of claim 14 wherein said lubricant blend is applied at an average coverage rate of about 40–70 mg/ft².

16. Beverage can end stock made of a metal sheet product and having a first and second outer surface, at least one of said surfaces being treated with about 4–35 mg/ft² of a lubricant blend consisting essentially of:

(a) about 40–90 wt % bis(2-ethylhexyl) sebacate; and (b) about 10–60 wt % petrolatum.

17. The end stock of claim 16 wherein said lubricant blend consists essentially of about 60–80 wt % bis(2-ethylhexyl)sebacate and about 20–40 wt % petrolatum.

18. The end stock of claim 16 wherein the metal sheet is made from a magnesium-containing aluminum alloy.

19. The end stock of claim 16 wherein said lubricant blend is applied at an average coverage rate of about 4–18 mg/ft².

20. A metal sheet product suitable for making into food or beverage can end stock, said end stock having a first and second outer surface, at least one of said surfaces being lubricated with about 4–35 mg/ft² of a blended composition comprising:

(a) about 40–90% by weight of bis(2-ethylhexyl) sebacate; and (b) about 10–60 wt % petrolatum.

21. The sheet product of claim 20 wherein the metal is aluminum.

22. The sheet product of claim 21 wherein the aluminum is a magnesium-containing aluminum alloy.

23. The sheet product of claim 20 wherein the composition is applied to both outer surfaces by a process selected from the group consisting of, electrostatic deposition, solvent, and roll coating.

24. The sheet product of claim 20 wherein said composition has been applied on at least one of its outer surfaces at an average coverage rate of about 4–18 mg/ft².

25. The sheet product of claim 20 wherein the composition consists essentially of about 60–85 wt % bis(2-ethylhexyl) sebacate and about 15–40 wt % petrolatum.

26. The sheet product of claim 25 wherein the composition consists essentially of about 75 wt % bis(2-ethylhexyl) sebacate and about 25 wt % yellow grade or higher petrolatum.

* * * * *